US012520991B2

(12) United States Patent
Kramer

(10) Patent No.: US 12,520,991 B2
(45) Date of Patent: Jan. 13, 2026

(54) WARE RACK FOR SUPPORTING WARES AND RELATED WAREWASH MACHINE AND METHODS

(71) Applicant: ILLINOIS TOOL WORKS INC., Glenview, IL (US)

(72) Inventor: Steven H. Kramer, Osgood, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 107 days.

(21) Appl. No.: 18/450,101

(22) Filed: Aug. 15, 2023

(65) Prior Publication Data

US 2024/0065522 A1 Feb. 29, 2024

Related U.S. Application Data

(60) Provisional application No. 63/401,935, filed on Aug. 29, 2022.

(51) Int. Cl.
*A47L 15/50* (2006.01)

(52) U.S. Cl.
CPC ..... *A47L 15/50* (2013.01)

(58) Field of Classification Search
CPC .... A47L 15/50; A47L 15/504; A47L 15/0081; A47L 15/501; A47L 15/0076; A47L 15/0092
See application file for complete search history.

(56) References Cited

U.S. PATENT DOCUMENTS 2,213,918 A * 9/1940 Lofstrand, Jr. ..... A47L 15/0065 206/427
3,214,031 A * 10/1965 Mccauley ..... A47B 81/04 D7/704
2008/0302399 A1 12/2008 Classen
2017/0367557 A1 12/2017 Anim-Mensah
2019/0000300 A1 1/2019 Anim-Mensah
2019/0046002 A1 2/2019 Fischer
2019/0191958 A1 6/2019 Carpenter
2020/0060505 A1 2/2020 Jarjour
2021/0015339 A1 1/2021 Fischer
(Continued)

FOREIGN PATENT DOCUMENTS

EP 1518490 A1 * 3/2005 ..... A47L 15/0065
EP 2664265 A1 * 11/2013 ..... A47L 15/50
(Continued)

*Primary Examiner* — Patrick D Hawn
(74) *Attorney, Agent, or Firm* — THOMPSON HINE LLP

(57) ABSTRACT

A ware rack for holding wares, such as long trays, to be washed includes a wire form unit configured with multiple tray loading stations. At least one tray loading station includes: an upper wire support extending laterally in a first rack direction from one side toward an opposite side of the rack; a first lower wire support extending laterally in the first direction and at a height that is lower than a height of the upper wire support; and a second lower wire support extending laterally in the first direction and at a height that is lower than the height of the upper wire support. At least one of the first lower wire support or the second lower wire support is offset, in a second rack direction from the upper wire support to form a tray receiving region, the second rack direction being perpendicular to the first rack direction.

11 Claims, 9 Drawing Sheets

(56) References Cited

U.S. PATENT DOCUMENTS

| | | | | |
|---|---|---|---|---|
| 2021/0393105 | A1 | 12/2021 | Carpenter | |
| 2022/0061626 | A1 | 3/2022 | Carpenter | |
| 2023/0309778 | A1* | 10/2023 | Kramer | A47L 15/0081 134/25.2 |
| 2024/0252017 | A1* | 8/2024 | Kramer | A47L 15/50 |

FOREIGN PATENT DOCUMENTS

| | | | | |
|---|---|---|---|---|
| EP | 2772181 | A1 * | 9/2014 | A47L 15/50 |
| EP | 4154794 | A1 * | 3/2023 | A47L 15/0081 |
| JP | 4592199 | B2 | 12/2010 | |
| KR | 20170003194 | U * | 9/2017 | A47J 47/20 |
| KR | 20200119564 | A * | 10/2020 | A47L 15/428 |
| WO | WO-2013036468 | A1 * | 3/2013 | A47L 15/501 |

* cited by examiner

WARE RACK FOR SUPPORTING WARES AND RELATED WAREWASH MACHINE AND METHODS

TECHNICAL FIELD

This application relates generally to warewash machines and, more specifically, to a rack configuration for use in warewash machines, such as hood-type machines.

BACKGROUND

Warewash machines have become fairly standardized in the industry. Typically, a standard warewasher has a washing chamber with an access opening that allows wares to be placed within the chamber for a washing operation. Larger washing chambers, especially taller chambers, are often desirable, where feasible. U.S. Pat. Nos. 10,806,323 and 5,630,438 describe variations of door systems usable in tall hood machines.

In commercial establishments, such as fast food restaurants, prep ware is a main type of ware that must be cleaned. For example, "UHC" trays (Universal Holding Cabinet trays) are commonly used, and these trays are longer than the twenty inches that is normally a limit for using a standard ware supporting rack and a standard undercounter or hood warewash machine. Previously developed solutions for such UHC trays have used a standard ware rack with a pivoting prop rod that can be used to hold up to 2 UHC trays, side-by-side in a single row, at about a 45 degree angle for washing in a standard machine. While workable, this solution dedicates an entire wash cycle to the cleaning of only two UHC trays.

Accordingly, it would be desirable to provide a more effective system for cleaning larger prep wares, such as UHC trays.

SUMMARY

In one aspect, a ware rack includes multiple tray loading stations configured to hold trays in an upwardly angled configuration.

In another aspect, a ware rack for holding wares to be washed in a chamber of a warewash machine includes a rack base having first, second, third and fourth sides, the first and second sides running in a first rack direction and located opposite each other and the third and fourth sides running in a second rack direction and located opposite each other. A wire form unit extends from the base, the wire form unit including: a first wire support raised above the rack base and running substantially along the first side of the rack base in the first rack direction; a second wire support raised above the rack base and running substantially along the second side of the rack base in the first rack direction; and at least one tray loading station running between the first wire support and the second wire support. The tray loading station includes: an upper wire support extending laterally between the first wire support and the second wire support, substantially in the second rack direction, and having a primary segment raised above the first wire support and the second wire support; a first lower wire support extending laterally between the first wire support and the second wire support, substantially in the second rack direction; a second lower wire support extending laterally between the first wire support and the second wire support, substantially in the second rack direction; wherein at least one of the first lower wire support or the second lower wire support is offset, in the first rack direction, from the upper wire support to form a tray receiving region.

In a further aspect, a ware rack for holding wares to be washed in a chamber of a warewash machine includes a wire form unit configured with multiple tray loading stations. At least one of the tray loading stations includes: an upper wire support extending laterally in a first rack direction from one side toward an opposite side of the rack; a first lower wire support extending laterally in the first direction and at a height that is lower than a height of the upper wire support; a second lower wire support extending laterally in the first direction and at a height that is lower than the height of the upper wire support; wherein at least one of the first lower wire support or the second lower wire support is offset, in a second rack direction from the upper wire support to form a tray receiving region, the second rack direction being perpendicular to the first rack direction.

In yet another aspect, a method of washing a tray in a warewash machine involves utilizing a ware rack including a wire form unit configured with a tray loading station comprising an upper wire support extending laterally in a first rack direction from one side toward an opposite side of the rack, a first lower wire support extending laterally in the first rack direction and at a height that is lower than a height of the upper wire support, and a second lower wire support extending laterally in the first rack direction and at a height that is lower than the height of the upper wire support, wherein at least one of the first lower wire support or the second lower wire support is offset, in a second rack direction from the upper wire support to form a tray receiving region, the second rack direction being perpendicular to the first rack direction; positioning a tray in the tray loading station of ware rack such that the tray is supported in an angled upright position that is offset from horizontal by at least fifty-five degrees.

The details of one or more embodiments are set forth in the accompanying drawings and the description below. Other features, objects, and advantages will be apparent from the description and drawings, and from the claims.

DETAILED DESCRIPTION

Figure 1:
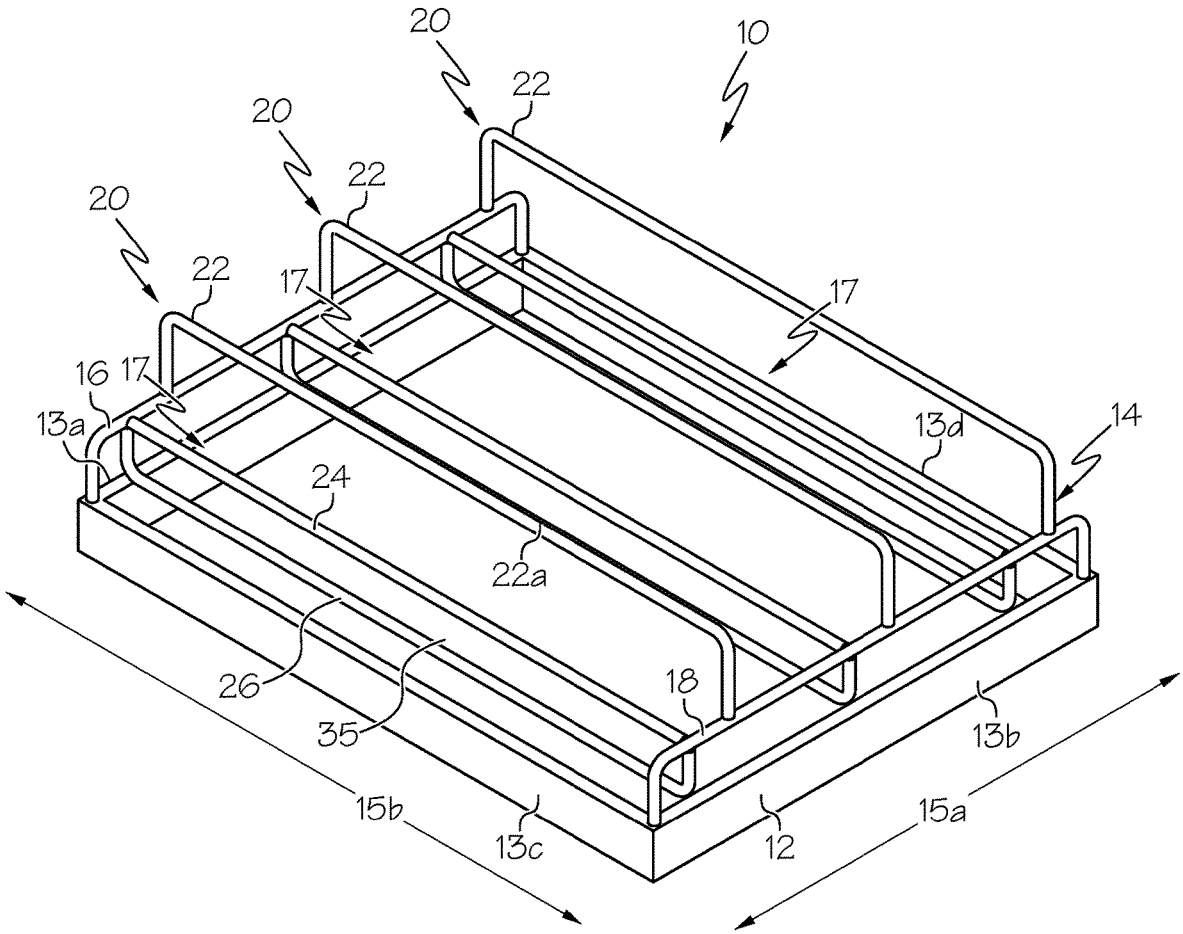
FIG. 1 shows one embodiment of a ware rack.

Referring to FIGS. 1-5, a ware rack 10 for holding wares to be washed in a chamber of a warewash machine includes a rack base 12 having first, second, third and fourth sides 13*a*-13*d*. The first and second sides 13*a*, 13*b* run in a rack direction 15*a* and are located opposite each other, and the third and fourth sides 13*c*, 13*d* run in a rack direction 15*b* and are located opposite each other. The base 12 may, for example, be a molded plastic structure where the region within the perimeter of the base sides is any of fully closed, fully open (e.g., the base is a four-sided frame structure per FIGS. 1 and 4) or partially open (e.g., as in the case of an open grid or lattice structure that allows passage of water therethrough but still provides some structure for supporting wares, if needed).

A wire form unit 14 is secured to the base (e.g., molded in, or fastened to or clipped to the base). The wire form unit 14 includes a first wire support 16 raised above the rack base 12 and running substantially along the first side 13*a* of the rack base in the rack direction 15*a*, a second wire support 18 raised above the rack base 12 (at the same height as wire support 16) and running substantially along the second side 13*b* of the rack base in the rack direction 15*a*. The wire form unit includes a plurality of UHC tray loading stations 20 running between the first wire support 16 and the second wire support 18. Each UHC tray loading station 20 includes an upper wire support 22 extending laterally between the first wire support 16 and the second wire support 18, substantially in the rack direction 15*b*, and having a primary segment 22*a* raised above the first wire support 16 and the second wire support 18. Each tray loading station 20 further includes a first lower wire support 24 positioned lower than primary segment 22*a* and extending laterally between the first wire support 16 and the second wire support 18, substantially in the rack direction 15*b*, and a second lower wire support 26 positioned lower than primary segment 22*a* and extending laterally between the first wire support 16 and the second wire support 18, substantially in the rack direction 15*b*. At least one of the first lower wire support 24 or the second lower wire support 26 is offset, in the rack direction 15*a*, from the upper wire support 22 to form a UHC tray receiving region 17.

Figure 2:
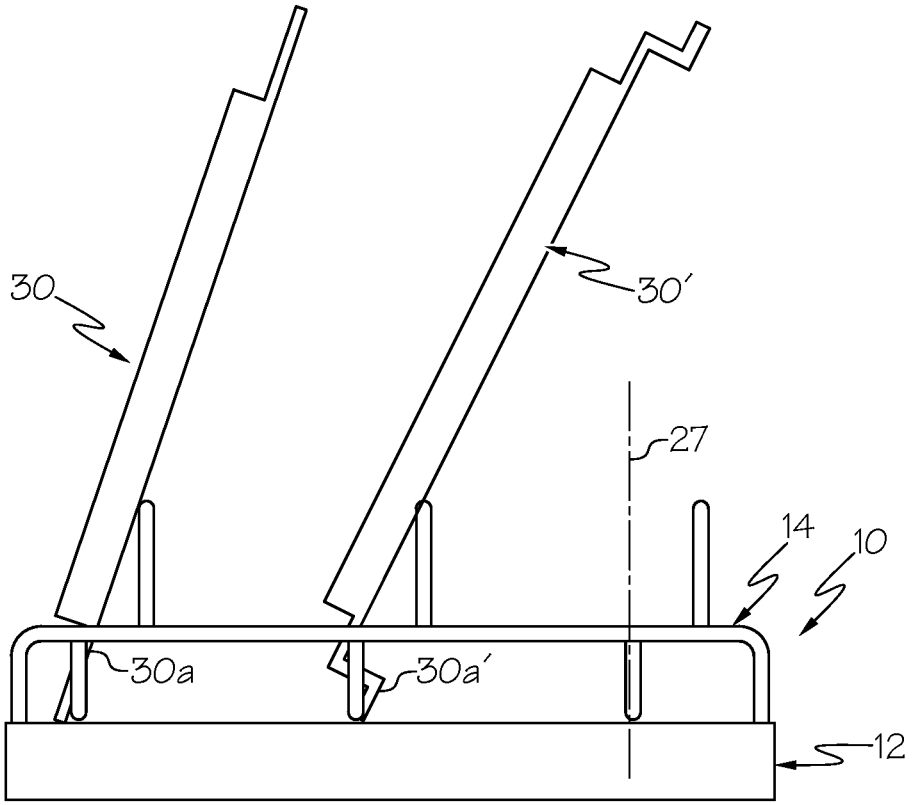
FIG. 2 shows a side elevation of the ware rack of FIG. 1, with exemplary trays loaded therein.
Figure 3:
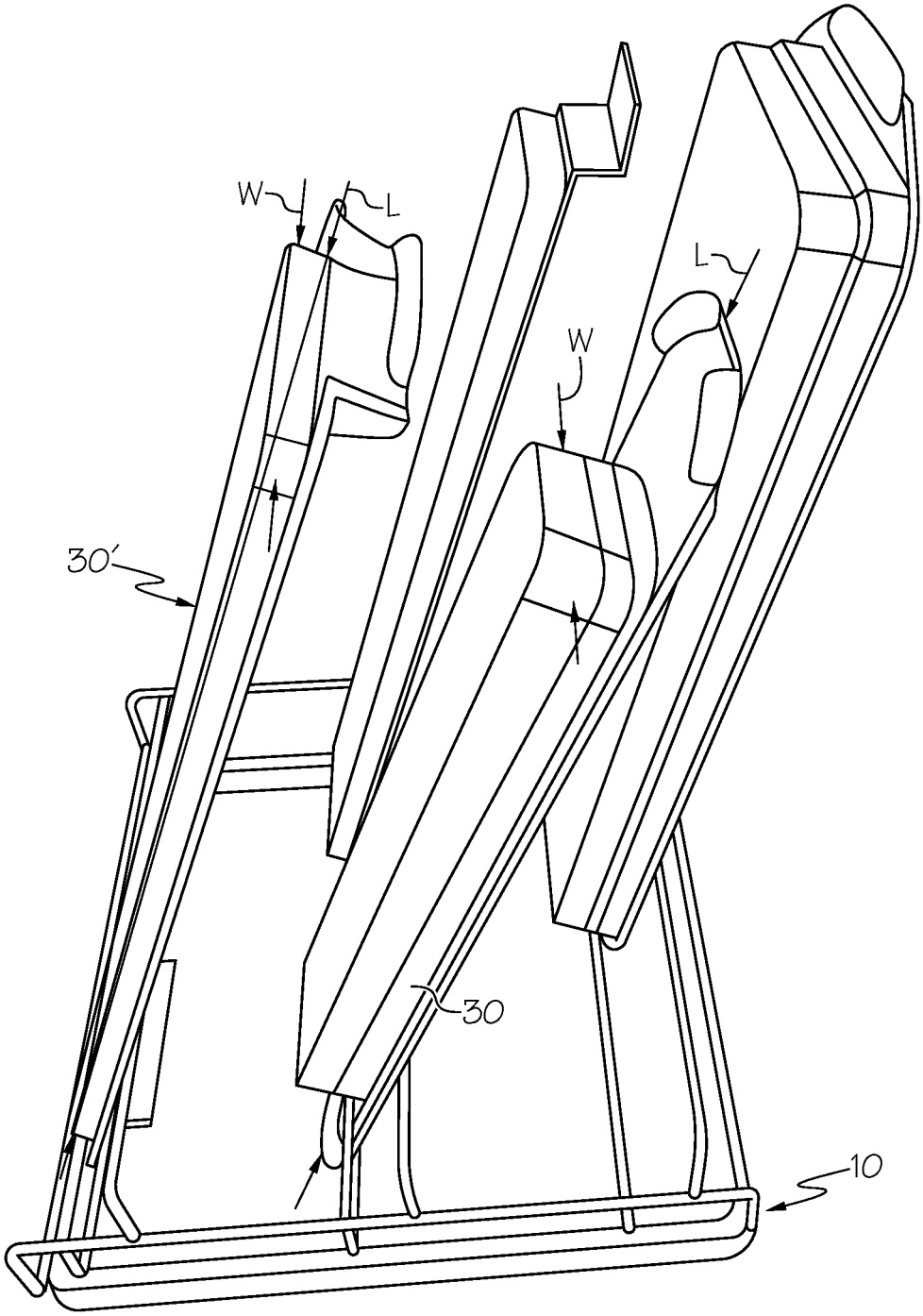
FIG. 3 shows a perspective view of the ware rack of FIG. 1, with exemplary trays loaded therein.

In the embodiment of FIGS. 1-3, both the first lower wire support 24 and the second lower wire support 26 are offset, in the rack direction 15*a*, from the upper wire support 22, and the second lower wire support 26 is positioned vertically below the first lower wire support 24 (wire supports 26 and 24 lie in the same vertical plane, e.g., plane 27). In this embodiment, a UHC tray 30, 30' may be loaded in a tray loading station, wherein the UHC tray 30, 30' includes a length L and a width W, the length being larger than the width. The UHC tray 30, 30' includes a handle portion 30*a*, 30*a*' along a first widthwise end of the UHC tray 30, 30', and the handle portion is positioned, at least partly, with a vertical gap 35 between the first lower wire support 24 and the second lower wire support 26, and another portion of the UHC tray 30, 30' rests against the upper wire support 22 such that the UHC tray 30, 30' is positioned in an angled upright position. Notably, here, the angled upright position is offset from horizontal by at least fifty-five degrees (such as by at least sixty-five degrees). Where the handle portion 30*a* is substantially aligned with the top edge of the tray body, as in the case of tray 30, the handle portion 30*a* may enter the gap 35 from a side that is toward the upper wire support 22. On the other hand, where the handle portion 30*a*' is in part vertically raised relative to the top edge of the tray body, as in the case of tray 30', the handle portion 30*a*' may enter the gap 35 from a side that is opposite the side of the upper wire support 22.

Figure 4:
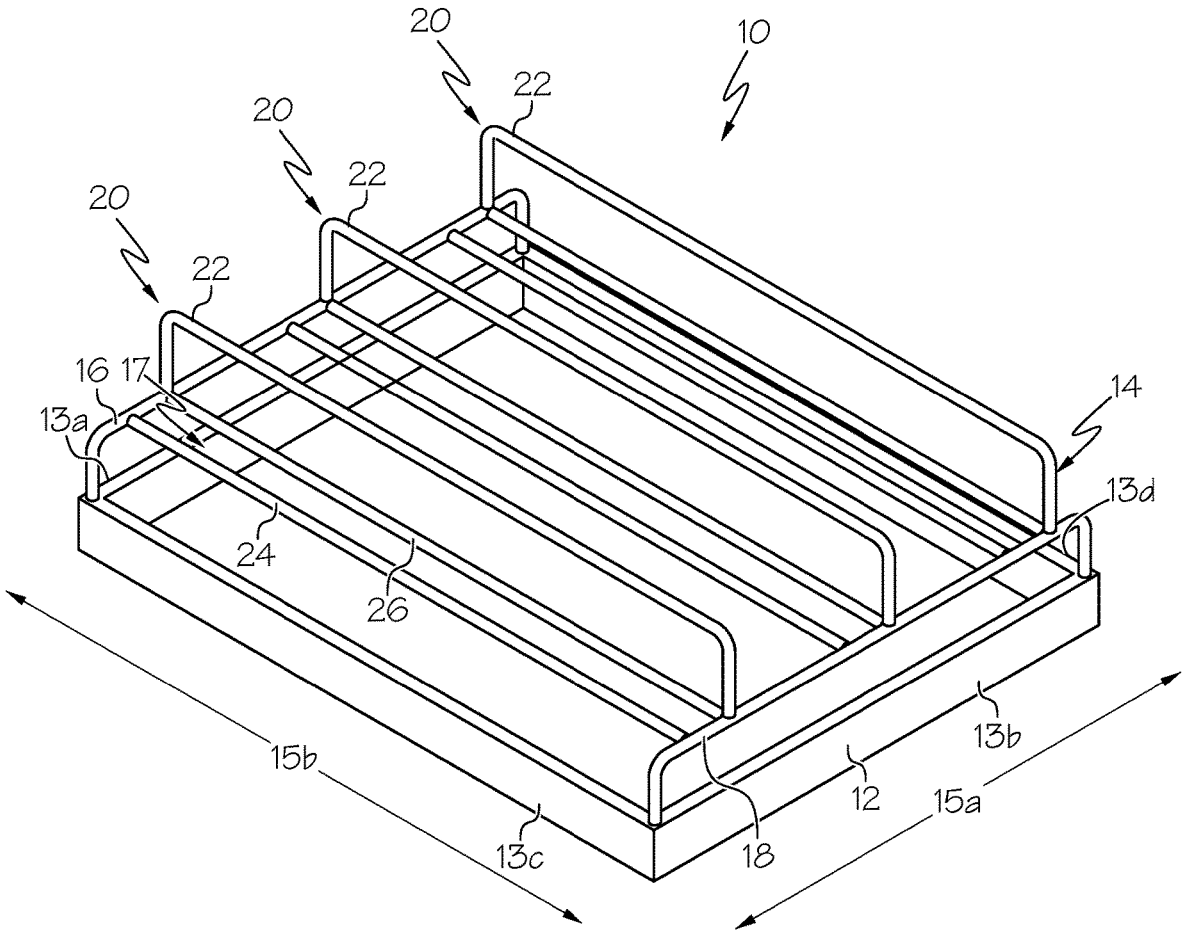
FIG. 4 shows another embodiment of a ware rack.
Figure 5:
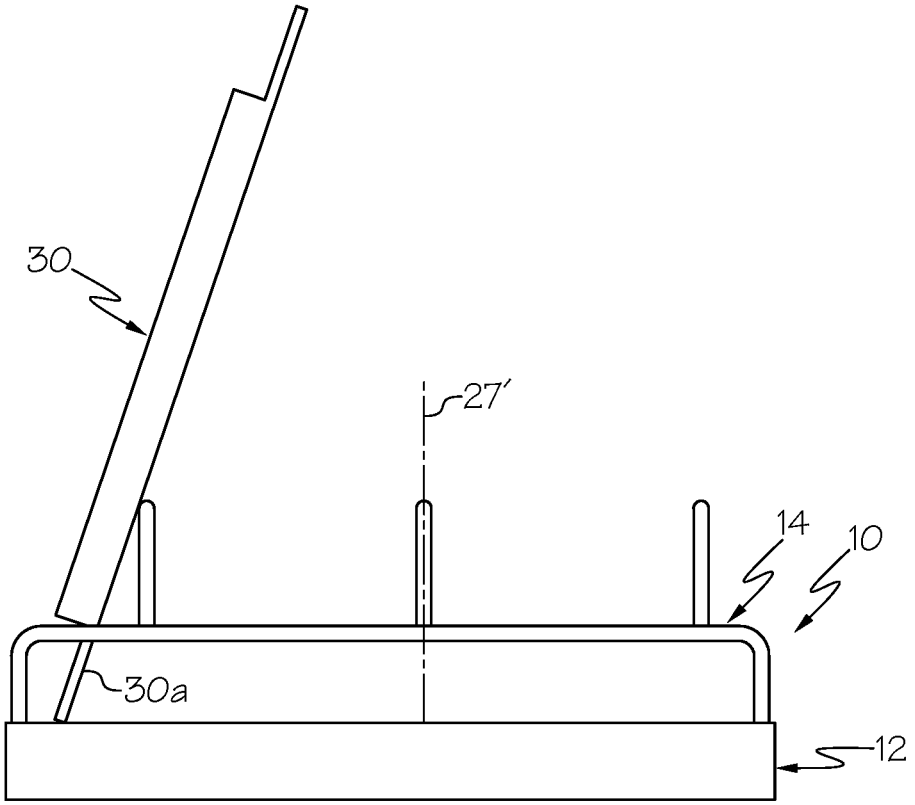
FIG. 5 shows a side elevation of the ware rack of FIG. 4, with exemplary tray loaded therein.

In in the embodiment of FIGS. 4-5, the first lower wire support 24 is offset, in the rack direction 15*a*, from the upper wire support 22, and the second lower wire support 26 is positioned vertically beneath the upper wire support 22 (wire supports 26 and 22 lie in a common vertical plane, e.g., plane 27'). In such embodiment, a UHC tray 30 may be loaded in a tray loading station 20, wherein the UHC tray includes a length and a width, the length being larger than the width, and the UHC tray includes a handle portion 30*a* along a first widthwise end of the UHC tray, and the handle portion 30*a* is positioned, at least partly, within a horizontal gap 37 between the first lower wire support 24 and the second lower wire support 26, and another portion of the UHC tray rests against the upper wire support 22 such that the UHC tray is positioned in an angled upright position. Notably, the angled upright position is offset from horizontal by at least fifty-five degrees (such as by at least sixty-five degrees).

In both above-described embodiments, three UHC tray loading stations 20 are spaced apart from each in the rack direction 15*a*. Also, as per FIG. 3, two trays may be positioned side-by-side in the same tray loading station 20, enabling both embodiments of the ware rack to support up to six long trays during each washing operation of a ware-wash machine (depending upon tray width).

Figure 6:
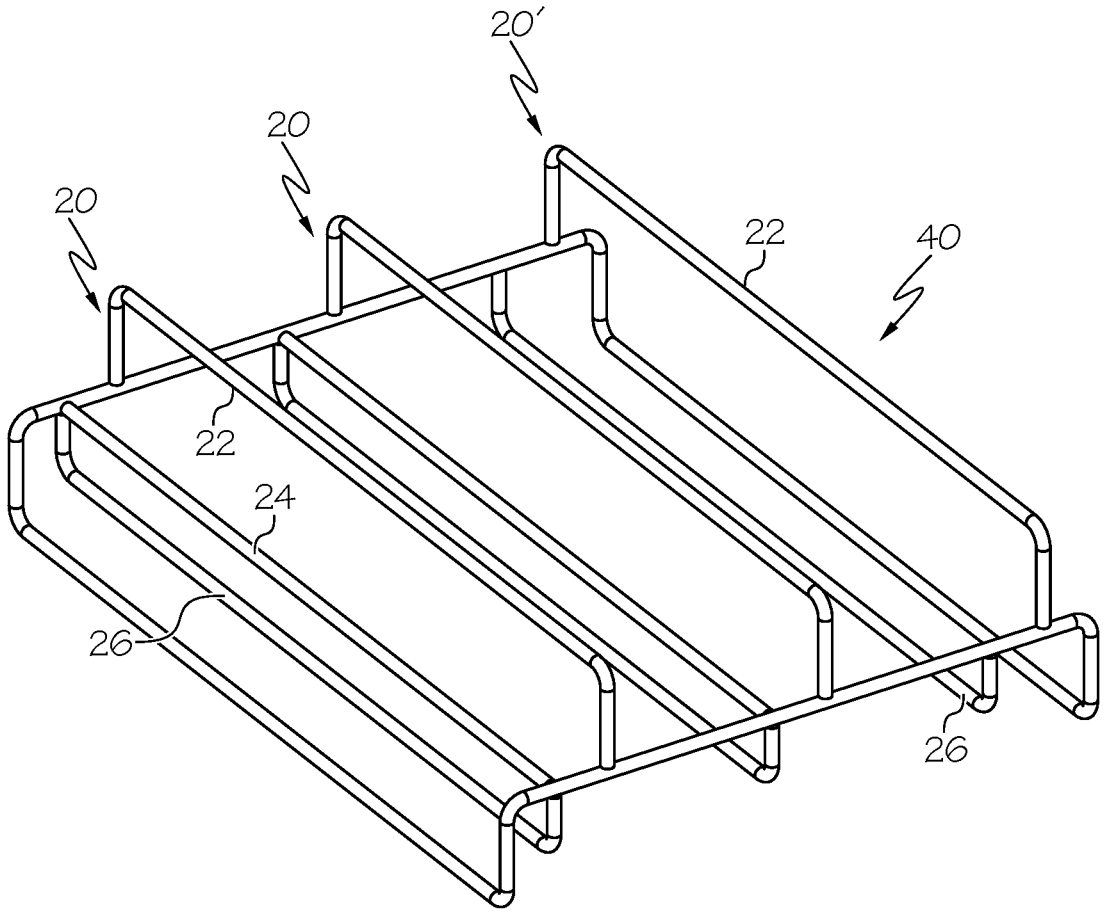
FIG. 6 shows a wire form member for a ware rack.
Figure 7:
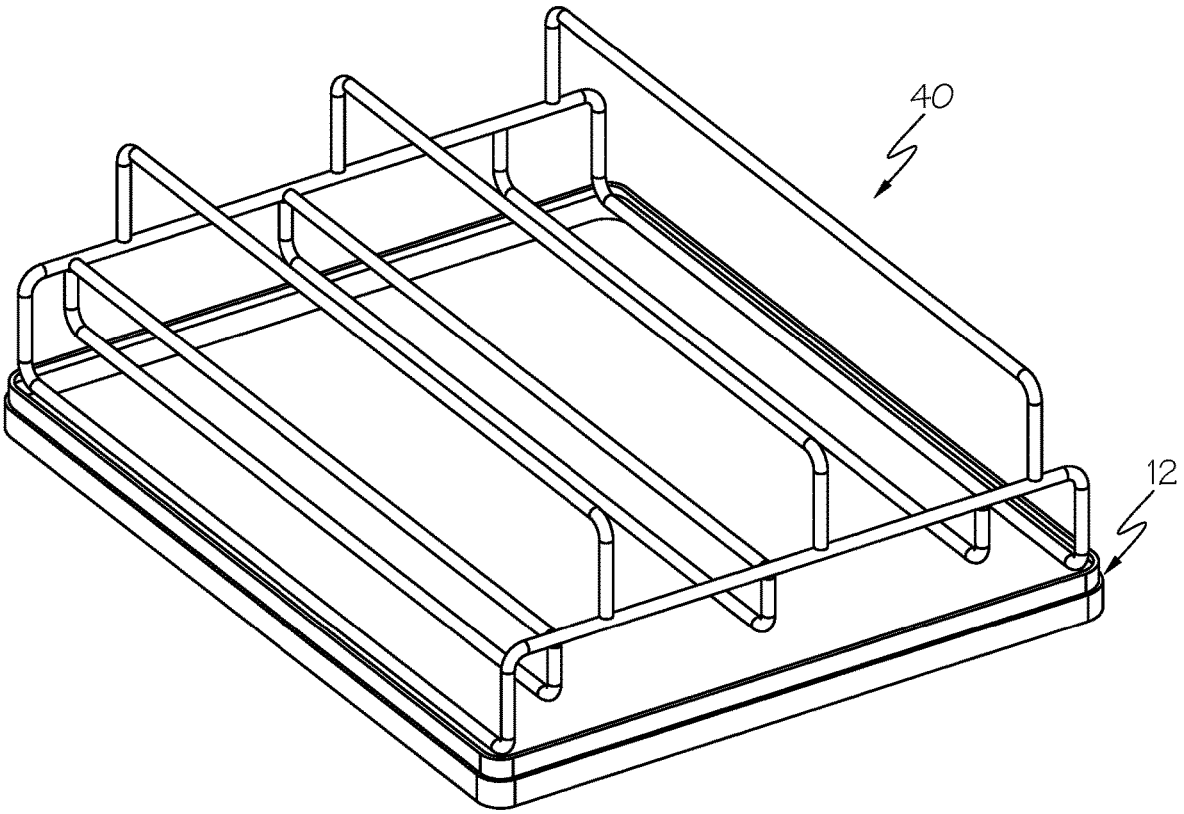
FIG. 7 shows the wire form member attached to a base.
Figure 8:
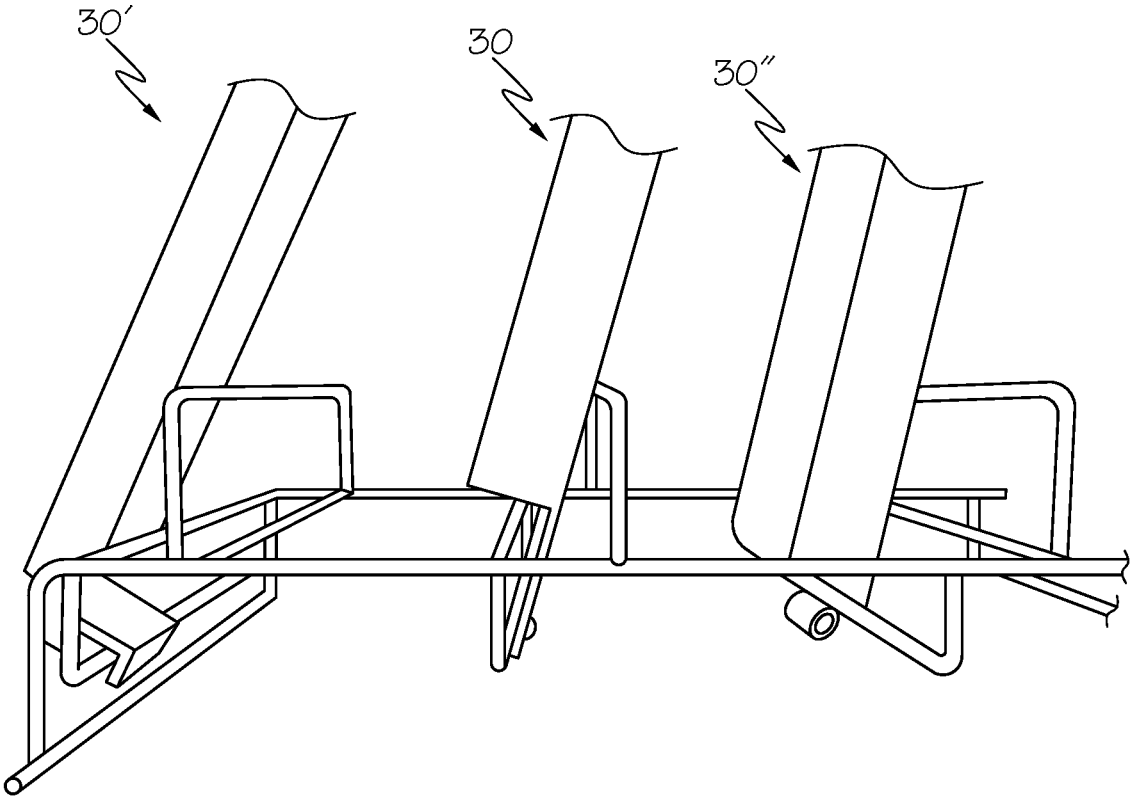
FIG. 8 shows the wire form member with exemplary trays loaded therein.

FIG. 6 shows a wire form unit 40, for use with a rack base, where the wire form unit includes two tray loading stations 20 that are similar to those of FIGS. 1-3, and a third tray loading station 20' that is configured differently, having only lateral wire portions 22 and 26. FIG. 7 shows the wire form unit mounted on a rack base. FIG. 8 shows that 3 different tray styles 30, 30' and 30" are accommodated by the wire form unit 40 of FIGS. 6-7, where tray 30" is a deeper tray that is better accommodated by the configuration of tray loading station 20'.

Figure 9:
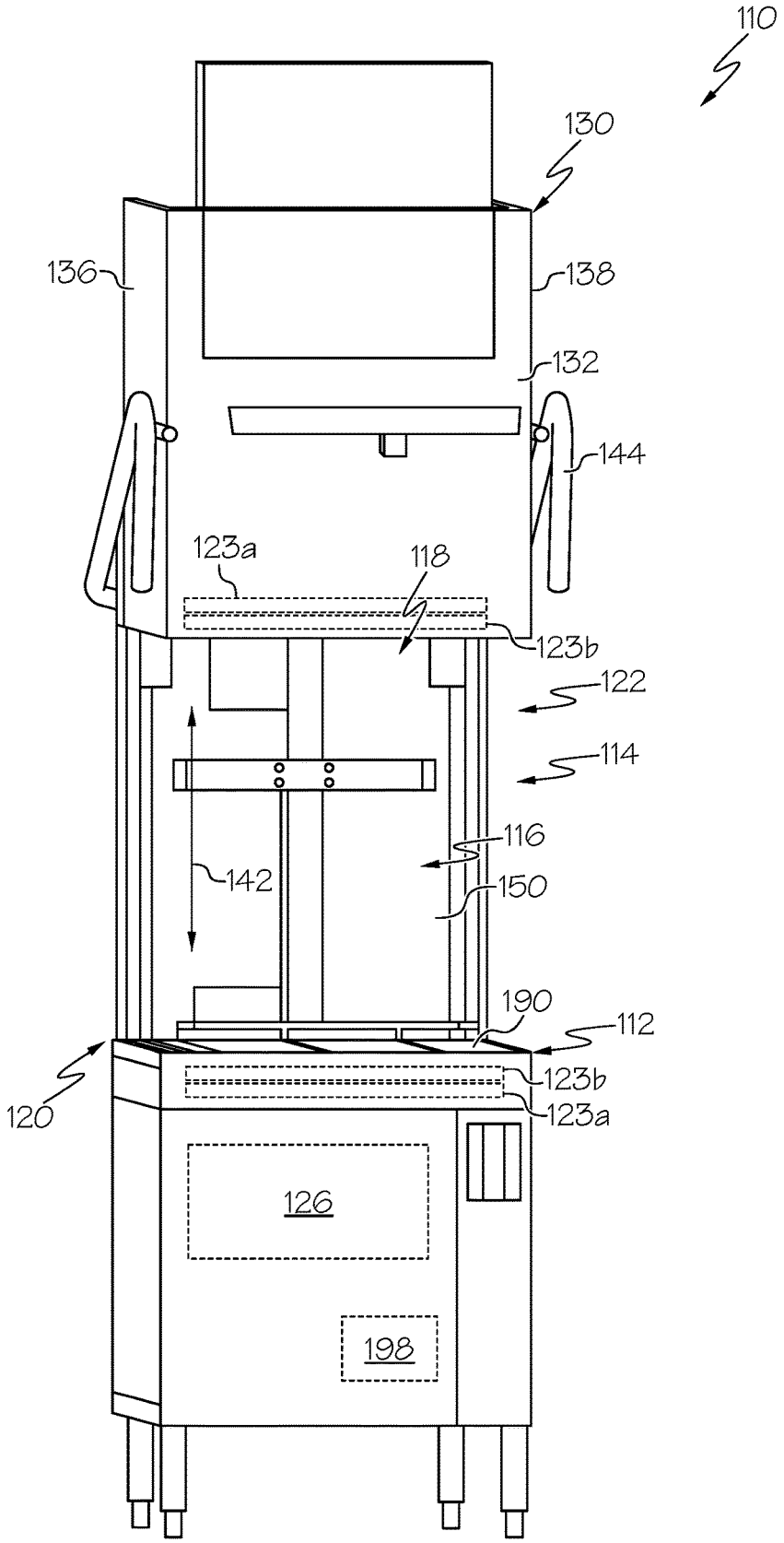
FIG. 9 shows an exemplary warewash machine.

FIG. 9 depicts a schematic view of a hood-type warewash machine 110 that includes a housing 112 (e.g., with support frame and panels) in part defining a treatment chamber 114 with a wash zone 116. The chamber 114 includes front 118, left 120 and right 122 access openings through which wares can be moved in and out of the chamber for cleaning. One or more upper and/or lower spray arms (e.g., wash arm(s) 123*a* and rinse arm(s) 123*b* having respective wash nozzles and rinse nozzles) are disposed above and/or below the wash zone. The spray arms are configured to spray liquid toward the wash zone 116. In a typical machine, both wash spray arms 123*a* and rinse spray arms 123*b* may be provided, with the wash spray arms fed by a pump that recirculates liquid from a collection sump or tank 126 below the wash zone, and the rinse spray arms fed by a pump (or line pressure) that delivers hot water from a hot water booster 198. The arms may, for example, be rotating arms and/or fixed arms.

A multi-sided hood assembly 130 includes movable front 132, left 136 and right 138 wall sections (e.g., forming a box-like hood structure that is open at the bottom) and the hood assembly may or may not have a moving top wall section and back wall section. The wall sections move together as a unit, such that the multi-sided hood assembly is movable (per arrow 142) between a lowered closed position for washing and a raised open position (e.g., per FIG. 1) for inlet and outlet of wares. When the multi-sided hood assembly is in the closed position, the hood assembly closes the front 118, left 120 and right 122 access openings so that cleaning sprays within the chamber will be contained during ware cleaning. When the multi-sided hood assembly is in the open position, the front 118, left 120 and right 122 access openings are open to permit access to the wash zone for inlet and egress of wares. A pivot handle 144 may be provided to facilitate operator movement of the hood assembly 130.

A stationary chamber rear wall 150 is disposed at the back or rear side of the treatment chamber and, in embodiments in which the hood assembly includes a rear wall section, the wall 150 is at least partly behind the hood rear wall section when the hood is closed.

A rack track 190 is removably supported at a lower portion of the treatment chamber in a substantially horizontal use orientation by support structure located at both the front and rear of the treatment chamber. By way of example, the support structure may be various internal housing surfaces and/or brackets. The illustrated rack track 190 is of a metal bar or wire form configuration, with upper bar sections aligned to define a rack support surface or rack support plane for a rack (such as any of the ware racks 10 described above) containing wares to be cleaned (e.g., dishes, glasses, pots and/or pans etc.). A rear rack slide rail and a forward rack slide rail may be provided, in positions raised relative to the rack support plane, for guiding the sliding movement of a rack from, for example, into the treatment chamber via the left side access opening 120 for cleaning, and then out of the treatment chamber via the right side access opening 122 after ware cleaning.

It is to be clearly understood that the above description is intended by way of illustration and example only, is not intended to be taken by way of limitation, and that other changes and modifications are possible.

The invention claimed is:

1. A ware rack for holding wares to be washed in a chamber of a warewash machine, comprising:

a rack base having first, second, third and fourth sides, the first and second sides running in a first rack direction and located opposite each other and the third and fourth sides running in a second rack direction and located opposite each other;

a wire form unit extending from the base, the wire form unit comprising:

a first side wire support raised above the rack base and running substantially along the first side of the rack base in the first rack direction;

a second side wire support raised above the rack base and running substantially along the second side of the rack base in the first rack direction; and a first tray loading station running between the first side wire support and the second side wire support, the first tray loading station comprising:

a first upper wire support extending laterally between the first side wire support and the second side wire support, substantially in the second rack direction, and having a primary segment raised above the first side wire support and the second side wire support;

a first lower wire support extending laterally between the first side wire support and the second side wire support, substantially in the second rack direction;

a second lower wire support extending laterally between the first side wire support and the second side wire support, substantially in the second rack direction;

wherein at least one of the first lower wire support or the second lower wire support is offset, in the first rack direction, from the first upper wire support to form a tray receiving region therebetween;

wherein both the first lower wire support and the second lower wire support are offset, in the first rack direction, from the first upper wire support, and the second lower wire support is positioned vertically beneath the first lower wire support; and wherein the wire form unit lacks any wire support structure vertically above and in alignment with the first lower wire support.

2. The ware rack of claim 1, wherein the wire form unit lacks any wire support structure vertically below and in alignment with the first upper wire support.

3. The ware rack of claim 2, further comprising a tray loaded in the first tray loading station, wherein the tray includes a length and a width, the length being larger than the width, where the tray includes a handle portion along a first widthwise end of the tray, wherein the handle portion is positioned, at least partly, with a vertical gap between the first lower wire support, and the second lower wire support and another portion of the tray rests against the first upper wire support such that the tray is positioned in an angled upright position.

4. The ware rack of claim 3, wherein the angled upright position is offset from horizontal by at least fifty-five degrees.

5. The ware rack of claim 3, wherein the angled upright position is offset from horizontal by at least sixty-five degrees.

6. The ware rack of claim 1, wherein an uppermost portion of the wire form unit is comprised by the primary segment of the first upper wire support.

7. The ware rack of claim 1, wherein a vertical height of the first lower wire support is the same as a vertical height of both the first side wire support and the second side wire support.

8. The ware rack of claim 1, wherein the wire form unit further comprises a second tray loading station is spaced apart from the first tray loading stating in the first rack direction, wherein the second tray loading station is identical in configuration to the first tray loading station.

9. A ware rack for holding wares to be washed in a chamber of a warewash machine, comprising:

a wire form unit configured with multiple tray loading stations, at least one of the tray loading stations comprising:

a first upper wire support extending laterally in a first rack direction from one side toward an opposite side of the rack;

a first lower wire support extending laterally in the first direction and at a height that is lower than a height of the first upper wire support;

a second lower wire support extending laterally in the first direction and at a height that is lower than the height of the first upper wire support;

wherein at least one of the first lower wire support or the second lower wire support is offset, in a second rack direction from the first upper wire support to form a tray receiving region therebetween, the second rack direction being perpendicular to the first rack direction;

wherein both the first lower wire support and the second lower wire support are offset, in the first rack direction, from the first upper wire support, and the second lower wire support is positioned vertically beneath the first lower wire support; and wherein the wire form unit lacks any wire support structure vertically above and in alignment with the first lower wire support.

10. The ware rack of claim 9, wherein the wire form unit lacks any wire support structure vertically below and in alignment with the first upper wire support.

11. The ware rack of claim 10, wherein an uppermost portion of the wire form unit is comprised by the first upper wire support.

* * * * *